US007931122B2

(12) United States Patent
Grandy

(10) Patent No.: US 7,931,122 B2
(45) Date of Patent: Apr. 26, 2011

(54) MANHOLE CONSTRUCTION SAFETY AND WORK PLATFORM DEVICE

(76) Inventor: Michael Allen Grandy, East Helena, MT (US)

( * ) Notice: Subject to any disclaimer, the term of this patent is extended or adjusted under 35 U.S.C. 154(b) by 535 days.

(21) Appl. No.: 12/076,563

(22) Filed: Mar. 20, 2008

(65) Prior Publication Data

US 2009/0236180 A1 Sep. 24, 2009

(51) Int. Cl.
*E04G 1/36* (2006.01)

(52) U.S. Cl. ..... 182/128

(58) Field of Classification Search ..... 182/128
See application file for complete search history.

(56) References Cited

U.S. PATENT DOCUMENTS 1,793,038 A 2/1931 Zimmerman
2,066,984 A 2/1938 Lamb
2,623,643 A 12/1952 Seamans
3,595,510 A * 7/1971 Hutchinson ..... 248/175
3,908,793 A 9/1975 Vaughn
4,407,392 A 10/1983 Lazzari
4,676,341 A * 6/1987 Shaffstall ..... 182/45
4,973,191 A * 11/1990 Dannhauser ..... 404/25
5,295,557 A 3/1994 Taylor
5,727,583 A * 3/1998 Kennedy ..... 135/20.1
5,853,066 A * 12/1998 Gohn ..... 182/20
6,830,127 B2 * 12/2004 Johnson ..... 182/113
6,848,539 B2 2/2005 Lee et al.

* cited by examiner

*Primary Examiner* — Alvin C Chin-Shue

(57) ABSTRACT

The invention is a manhole construction safety and work platform device having a scaffold catwalk for working on a manhole, providing the safety and work platform with adjustable braces engaging the side of a conical manhole casing. The inner perimeter of the device circumferentially defines a central access opening in order to slidably accept, receive, and fit around the conical section of the manhole casing, as typically used in the utility construction industry. The scaffold catwalk has a safety barrier means on the working surface to provide a safe working environment along the outer perimeter. As is common in the industry, the conical section of the manhole casing may be an asymmetrical conical section. One objective of the present invention is to provide a scaffolding platform supported with at least three adjustable brace members to securely support the said platform against the sidewall of any shape of manhole casing.

3 Claims, 6 Drawing Sheets

MANHOLE CONSTRUCTION SAFETY AND WORK PLATFORM DEVICE

BACKGROUND OF THE INVENTION

The present invention relates to the field of improvements in safety and work scaffold catwalks, decks and platforms for use in utility construction projects, and more particularly providing temporary access and fall protection for safe access to un-backfilled sewer manholes, by use of a temporary installable and removable safety and work platform installed to the outside of the pre-fabricated manhole casing or utility openings during a utility construction project.

In the construction and installation of underground utilities, particularly water, sewer, and storm sewer utilities, there has been no safe way for construction workers to safely work on a manhole before or during installation of the manhole casing. During the construction process, a contractor must dig a hole for the construction casing and sewer or other utility line, varying in depth from four feet to thirty feet. Then, trench shoring may be provided to shore the construction excavation. Three to five concrete sections of manhole casing are first set in this excavation to provide the manhole access to the utility hole. The distance from top of the manhole casing to the floor of the excavation, therefore, can be considerable, creating a safety and work problem.

The manhole casing used in such utility construction is comprised of concrete sections having one of two shapes, a cone or conical shape for the surface access section and a vertical cylindrical shape for the remaining sections to the manhole construction. The conical section may be symmetrical or asymmetrical, and is typically asymmetrical in such utility construction in the industry.

A project surveyor will supply the contractor with a survey grade and alignment hubs in order for the first manhole casing section to be set on the utility line. When the first section is set "on grade", and successfully surveyed and aligned, the contractor will then vertically stack the remaining sections of the manhole casing. The last or uppermost section of the manhole casing is generally an asymmetric conical section. A four-foot section of manhole casing is generally used as the industry standard for each section.

Where the conical section is asymmetrical, the conical section has a straight or vertical portion and an angled portion. The present invention provides adjustable braces to support a scaffolding deck or platform engaging the side of the manhole casing, to provide stability and support. Where there is an asymmetrical conical section, these braces must be of adjustable angles and lengths so that each may completely engage, in varying lengths, the respective, variable portions of the sidewalls of the asymmetrical conical section. It is an objective of the present invention to provide a scaffolding platform or deck supported with adjustable braces to securely support the platform against the sidewalls of any shape of manhole casing.

A pipe laser instrument is placed into the bottom section of the manhole in order to facilitate in assuring that the pipe coming out of the manhole is on grade. A transit survey instrument is used in cooperation with the laser instrument to ensure this alignment. The transit must be clamped by an equipment worker to the outer rim of the topmost conical section of the manhole casing, and a plumb bob is attached to the transit and lowered down through the manhole casing to a pre-determined point on the laser to establish "true line" and grade, thereby facilitating proper alignment.

Installation and operation of the transit and laser instruments are critical for establishing correct grade for the manhole casing and pipe. Currently, apart from the present invention, there is no way for an operator or worker to safely install a line level and survey instruments or to check and re-check the alignment of the manhole casing and pipe from the top of the manhole casing. Once the last manhole casing section is set, the operator has no safe way to install the drop transit from the edge of the top, conical section of the manhole casing. At this point in the construction project, the manhole casing is generally several feet above the base level of the excavation. One of the objects of the present invention is to solve a safety problem for the worker at this juncture of the process, allowing the operator to stand over the manhole casing to install the drop transit without the risk of falling or losing the equipment, another object of the present invention.

Pursuant to fall protection rules set forth by the U.S. Occupational Safety and Health Administration ("OSHA") regulations, any situation where the operator or other worker is above six feet from the floor of the working space, he or she has to have adequate fall protection. Prior to the present invention, such workers have had no adequate means of standing on top of a manhole casing in order to install a drop transit on the side of the manhole casing to accomplish this alignment process or perform other activities, in view of the open excavation and safety issue and concurrently comply with the OSHA regulations. Another object of the present invention is to provide fall protection consistent with OSHA regulations for operations in the construction and installation of underground utilities with manhole casings.

The present invention, therefore, eliminates fall protection non-compliance in violation of OSHA regulations if installed on the manhole casing as provided by the device and method of the present invention.

A safety barrier means such as a handrail is installed with a work access opening on the perimeter of the scaffold catwalk to this embodiment of the present invention. A further object of the present invention is to accommodate access and egress to an un-backfilled manhole by use of the scaffold catwalk to the present invention with a safety barrier means such as handrails, thereby providing access to a safety barrier around the scaffold catwalk, further eliminating the danger of falls.

The device of the present invention slides over the top of the conical section of the manhole casing before the conical section is set on top of the vertical sections, thereby immediately providing fixed, safe access to the manhole casing, allowing workers to walk on the scaffold catwalk out to the top of the manhole casing and clamp the alignment grade survey instruments necessary to provide proper grade. The present invention gives access throughout the operation and installation of the utility line, such as a sewer line, and for removal of the alignment and grade instruments while at the same time providing adequate fall protection pursuant to law. The present invention gives safe and quick access to manhole casings during construction and installation of the manhole, another object of the invention.

As noted, a primary object of the present invention is to provide fall protection and access to the manhole casing for safe use by operators or other workers. Another object of the invention is to provide this fall protection in an efficient time frame. Prior inventions have no way of providing access to un-backfilled sewer manhole casings to set up the laser alignment transit and at the same time provide safe and OSHA-compliant access adequate for fall protection. Related art provides information regarding work platforms which may be installed on top of casing or other conduits, such as U.S. Pat. No. 5,295,557 to Taylor and U.S. Pat. No. 6,830,127 B2 to Johnson. Both Taylor and Johnson describe work platforms attached to and covering the top of manhole casings or conduits, with platforms adapted to engage and mount the top portion of a manhole during construction. Neither of these two references teach the features of the proposed device of the present invention, engaging the side of the manhole casing preferably below the top edge or providing for adjustable braces to support a scaffolding deck or platform against the sidewalls of said casing. Neither of the patents to Johnson or Taylor disclose a central opening for receiving the conical portion of the manhole. Nor can the other cited references be modified to receive such a manhole conical section. Therefore, these references cited as examples of prior related art fail to show, describe, or suggest the present invention. The present invention, as disclosed and claimed hereby provides distinct and useful advantages not previously known in this field of utility, construction, safety and work platforms.

References to related art provided further information teaching scaffolding devices for smokestacks and silos extending through a central opening, such as U.S. Pat. No. 20,653 to Lamb, and U.S. Pat. No. 2,623,643 to Seamans. Lamb and Seamans disclose scaffolding having braces extending beneath said scaffolding for supporting sidewalls of a silo or smokestack. However, neither Lamb nor Seamans disclose a concave platform in a single unit that circumferentially engages a conical casing. While Lamb and Seamans disclose braces extending beneath scaffolding for supporting sidewalls of a silo or smokestack, these devices are not adapted for use against an asymmetrical, conical or sloping sidewall and are not adjustable to perform such function. The braces of the present invention accommodate both the angled and vertical sidewalls of a manhole casing. The angular adjustment holes of the present invention are not an obvious modification of Seamans or Lamb because silos, smokestacks, and other disclosures of the prior related art do not have asymmetrical, conical walls in which such patented inventions have the adjustable braces as elements. While providing for some means of bracing, none of the related art patents provide the features of the adjustable braces found in the present invention. Therefore, the references cited as example of prior related art taken alone or in combination fail to show, describe, or suggest the present invention.

Still further objects of the present invention will become apparent from a consideration of the ensuing descriptions and drawings.

SUMMARY OF THE INVENTION

Although the related art patented inventions provide features for utility, construction, safety and work platform devices, none provide the combination of the safety and work platform with the adjustable braces engaging the side of a conical manhole casing as found in the device of the present invention.

The preferred embodiment of the invention is a manhole casing safety and work platform device having a scaffold catwalk constructed of a grating means for working on a manhole casing. The inner perimeter of the device circumferentially defines a central access opening in order for said device to slidably accept, receive and fit around the conical section of manhole casing, typically used in the utility construction industry. The conical section has an angled sidewall portion overlying a vertical sidewall portion.

The scaffold catwalk has a safety barrier means on the working surface of the scaffold catwalk to provide a safe working environment along the outer perimeter which may be a handrail or other type of barrier protection commonly used in the industry to provide safety and security to the operator while working on the scaffold catwalk.

There are at least three adjustable brace members comprising an exterior tubing member, an interior tubing member, an exterior fixed pin anchor, and an interior fixed pin anchor pad. The interior free end of the interior tubing member fits slidably and cooperatively within the exterior free end of the exterior tubing member whereby the exterior and interior tubing members have a plurality of adjustable setting holes cooperatively located along said tubing members for adjustable engaging the respective tubing members together by inserting a setting means within said respective and cooperatively located adjustable setting holes.

The interior tubing anchor has an anchor pad for securely engaging and positioning each of the at least three adjustable braces in frictional contact against the sidewall of the manhole casing, each of said brace members extending from the underside surface of the scaffold catwalk and adjusted in length by the adjusting mechanism provided by the exterior tubing member, the interior tubing member, and the plurality of adjustable setting holes to contact the sidewall whereby the adjustable exterior and interior tubing members engage the angled sidewall portion and the vertical sidewall portion of the conical section of the manhole casing. The manhole casing safety and work platform device is safely and securely positioned against the sidewall of the manhole casing.

As is common in the industry, the conical section of the manhole casing may be an asymmetrical conical section. One objective of the present invention is to provide a scaffolding platform or deck, the manhole casing safety and work platform device of the present invention supported with at least three adjustable brace members to securely support said platform against the sidewall of any shape of manhole casing.

Other and further objects and advantages of the present invention will appear hereinafter.

BRIEF DESCRIPTION OF THE DRAWINGS

Other objects and features will become apparent from the following detailed description taken in combination with these accompanying drawings. However, the drawings are provided for the purpose of illustration only, and are not intended as a definition of the limits of the invention.

Similarly referenced characters denote corresponding features throughout the accompanying drawings.

DETAILED DESCRIPTION OF THE INVENTION

The present invention will now be described more fully hereinafter with reference to the accompanying drawings, in which the preferred embodiment of the invention is shown. This invention may, however, be embodied in different forms and should not be construed as limited to the embodiment set forth herein. Rather, the illustrative embodiment is provided so that this disclosure will be thorough and complete, and will fully convey the scope of the invention to those skilled in the art. Like numbers refer to like elements throughout.

Figure 1:
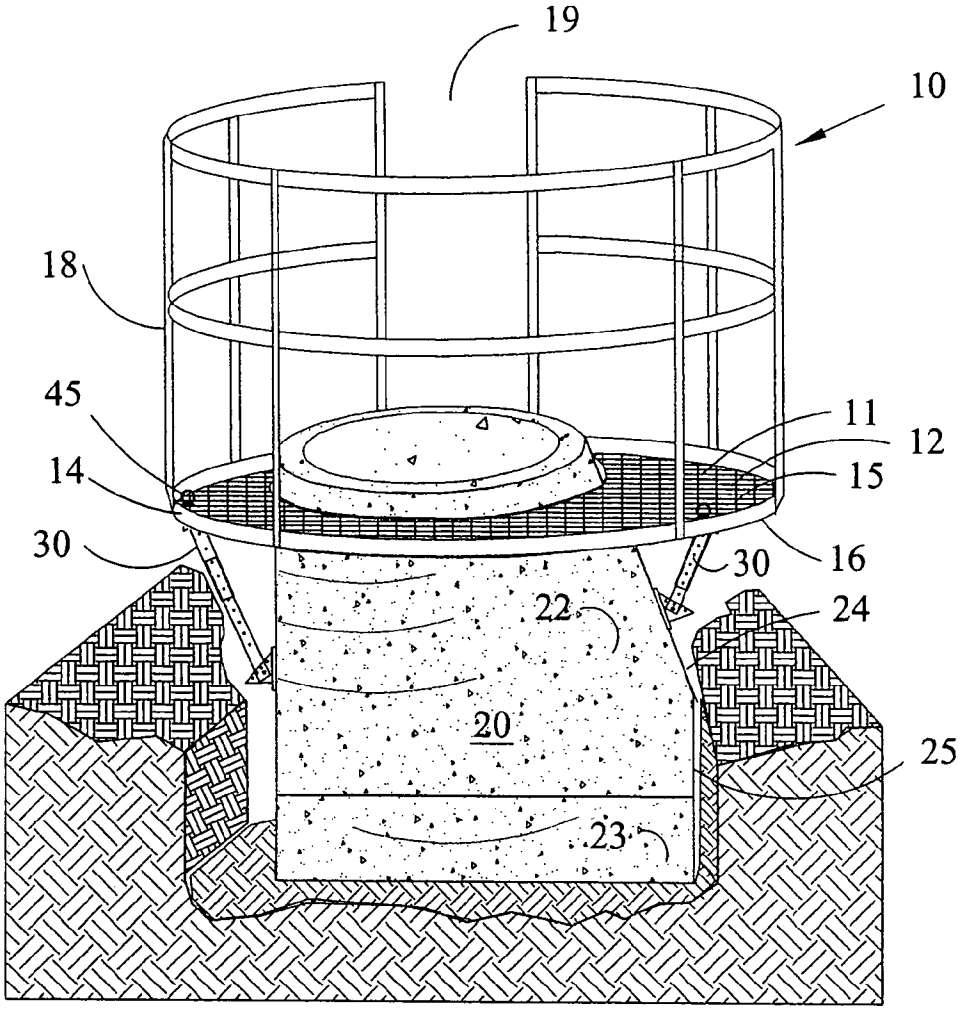
FIG. 1 is a perspective view of this embodiment of the manhole construction safety and work platform device, in accordance with the present invention.
Figure 2:
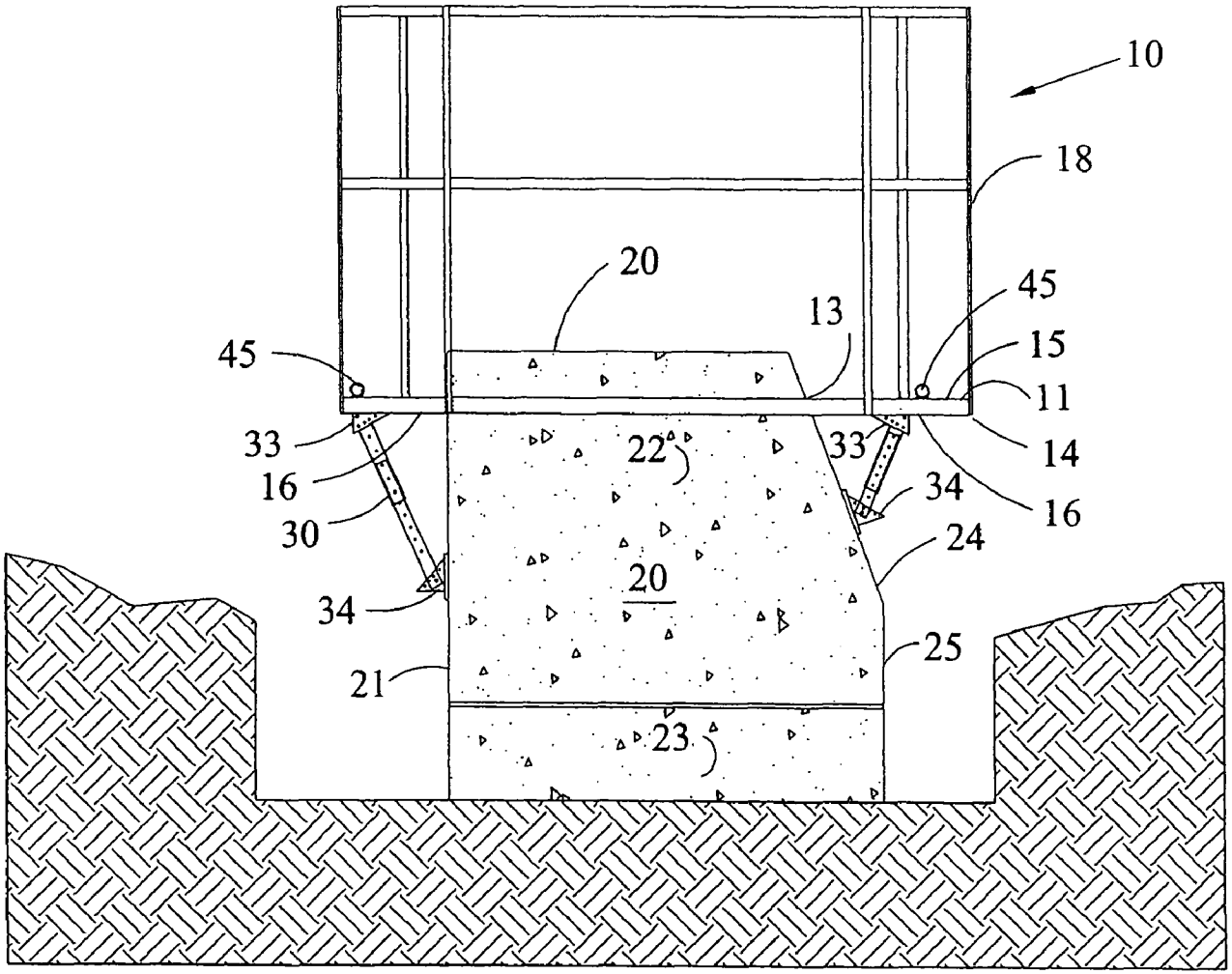
FIG. 2 is an elevation view of this embodiment of the manhole construction safety and work platform device in accordance with the present invention.

Now, turning in detail to the drawings, the preferred embodiment of the invention is shown in FIG. 1, a perspective view of the manhole casing safety and work platform device 10, having a scaffold catwalk 11 constructed of a grating means 12 for working on a manhole casing 20. As depicted in FIG. 2, the scaffold catwalk 11 has an inner perimeter 13, an outer perimeter 14, a working surface 15 and an underside surface 16. The device of the present invention is constructed of rigid, metallic material, such as steel, aluminum or other fabricated metallic material.

As shown in FIG. 2, the inner perimeter 13 circumferentially defines a central access opening 17 (depicted in FIGS. 3 and 4), in order for said device 10 of the present invention to slidably accept, receive and fit around the manhole casing 20. The manhole casing 20, as is typically used in the utility construction industry, has a sidewall 21 having a conical section 22 and one or more vertical sections 23, depending on the height of the vertical casing construction requirement per a particular job, shown in detail in FIG. 2. As depicted in FIG. 2, the conical section 22 has an angled sidewall portion 24 overlying a vertical sidewall portion 25. The central access opening 17, exhibited in FIGS. 3 and 4, is constructed and adapted to slidably and securely receive the conical section 22 of the manhole casing 20, as mentioned above, to allow said device 10 to fit securely and snugly around the manhole casing 20, as depicted in FIG. 1.

Figure 3:
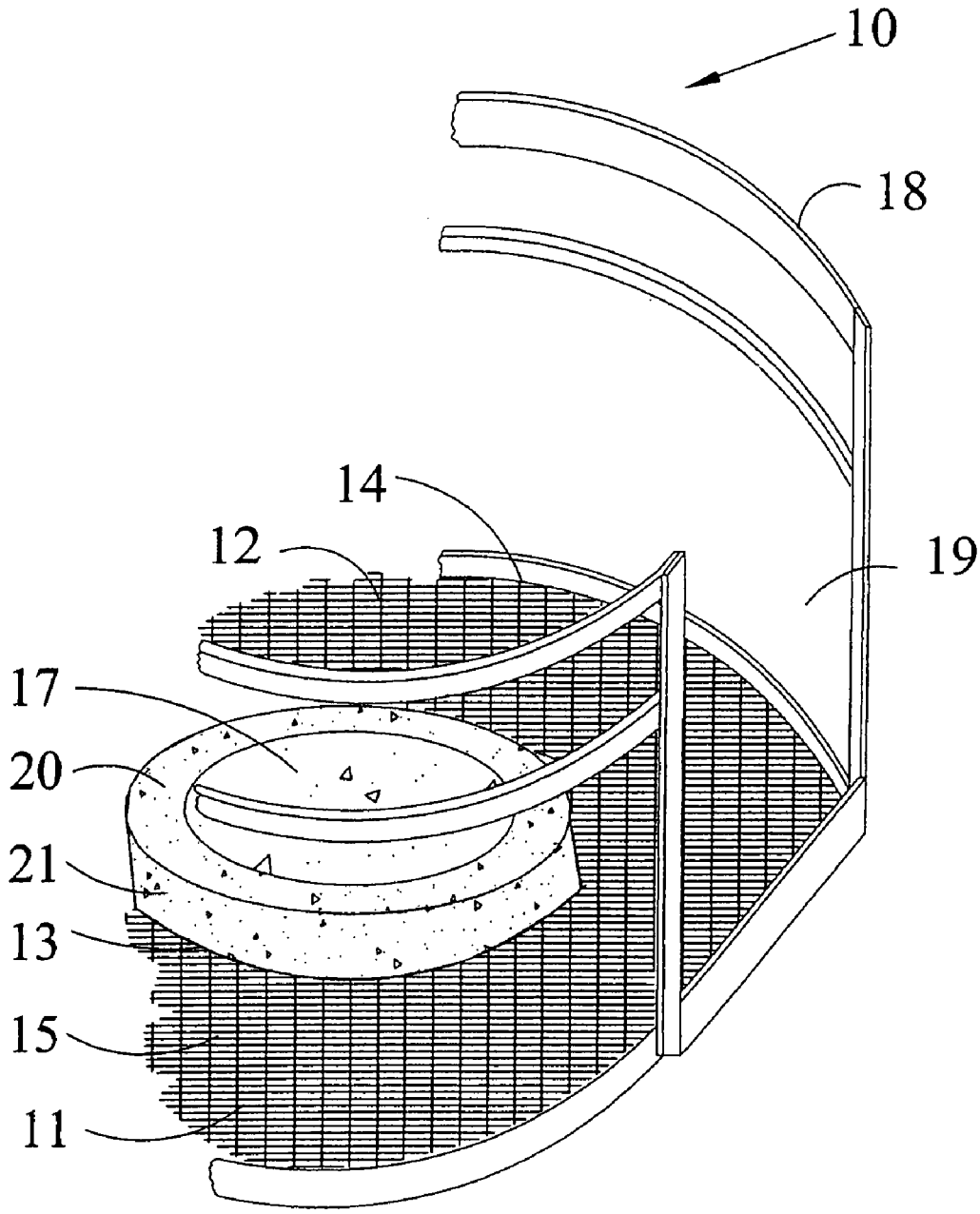
FIG. 3 is a partial perspective of the scaffold catwalk, working surface, and safety barrier means to the manhole construction safety and work platform device in accordance with the present invention.
Figure 4:
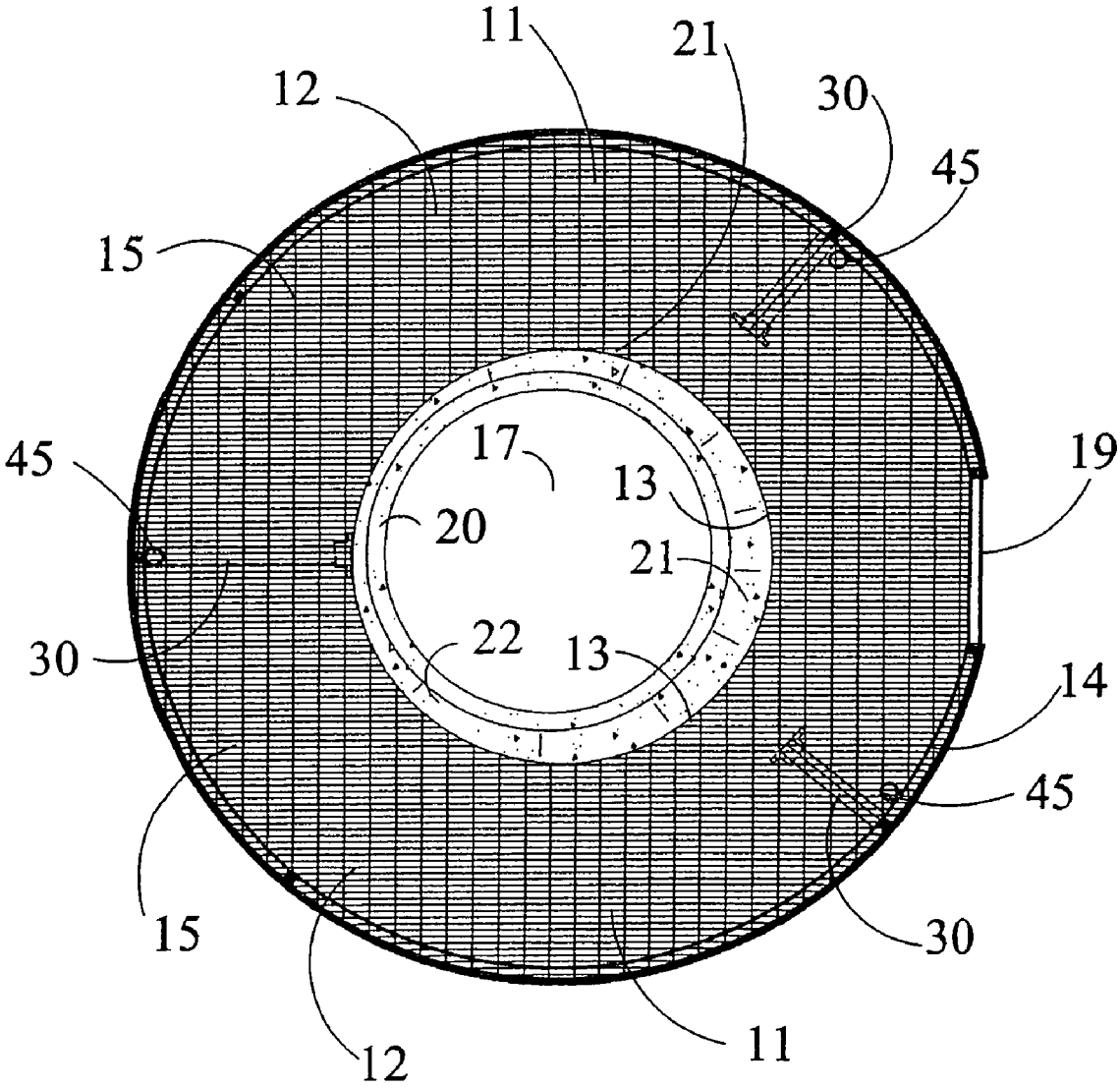
FIG. 4 is a top plan view of the scaffold catwalk, working surface, and safety barrier means to the manhole construction safety and work platform device in accordance with the present invention.

As shown in FIGS. 1 and 3, the scaffold catwalk 11 has a safety barrier means 18 located on the working surface 15 and along the outer perimeter 14 of the scaffold catwalk 11, to provide a safe working environment along the outer perimeter 14. The safety barrier means 18 has a work access gap 19 allowing easy operator access to the scaffold catwalk 11. The safety barrier means may be a handrail or other type of barrier protection commonly used in the industry to provide safety and security to the operator while working on the scaffold catwalk 11.

Figure 5:
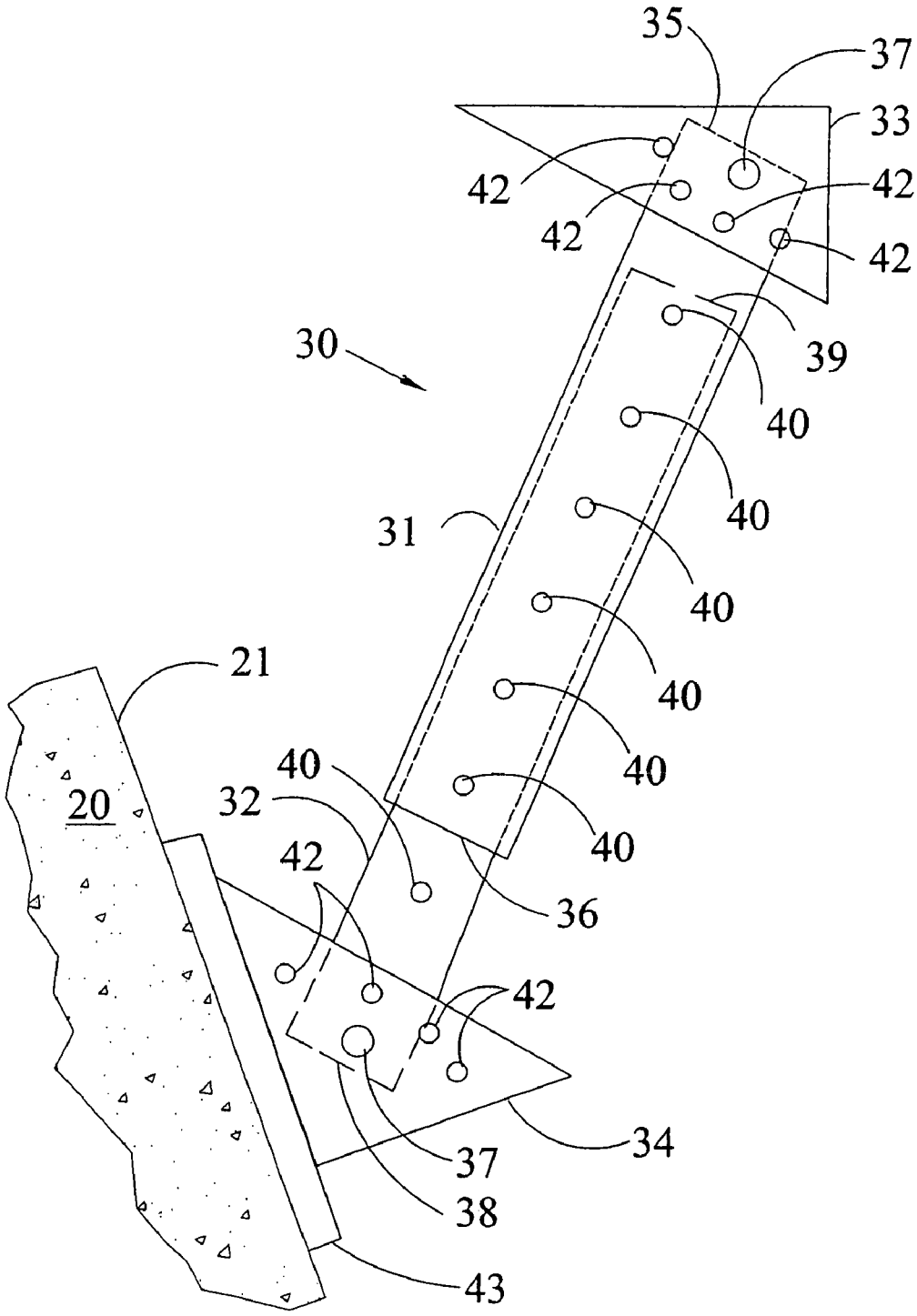
FIG. 5 is an elevated side view of one of the at least three adjustable brace members to the manhole construction safety and work platform device in accordance with the present invention.

There are at least three adjustable brace members 30 to the present invention, two of which are depicted by FIGS. 1 and 2, said brace members 30 comprising an exterior tubing member 31, an interior tubing member 32, an exterior fixed pin anchor 33, and an interior fixed pin anchor pad 34, as further shown in FIG. 5. As depicted in FIG. 5, the exterior tubing member 31 has an exterior attached end 35 pivotally attaching to the exterior tubing anchor 33, and an opposing exterior free end 36. The exterior tubing anchor 33, as shown in FIG. 5, is attached to the underside surface 16 proximate to the outer perimeter 14 of the scaffold catwalk 11, depicted in FIG. 2, the exterior tubing member 31 pivotally attaching to the exterior tubing anchor 33 by a fastening means 37. The fastening means may be a pin, screw or bolt or other fastening means commonly used in industry to pivotally secure similar materials of metal.

Figure 6:
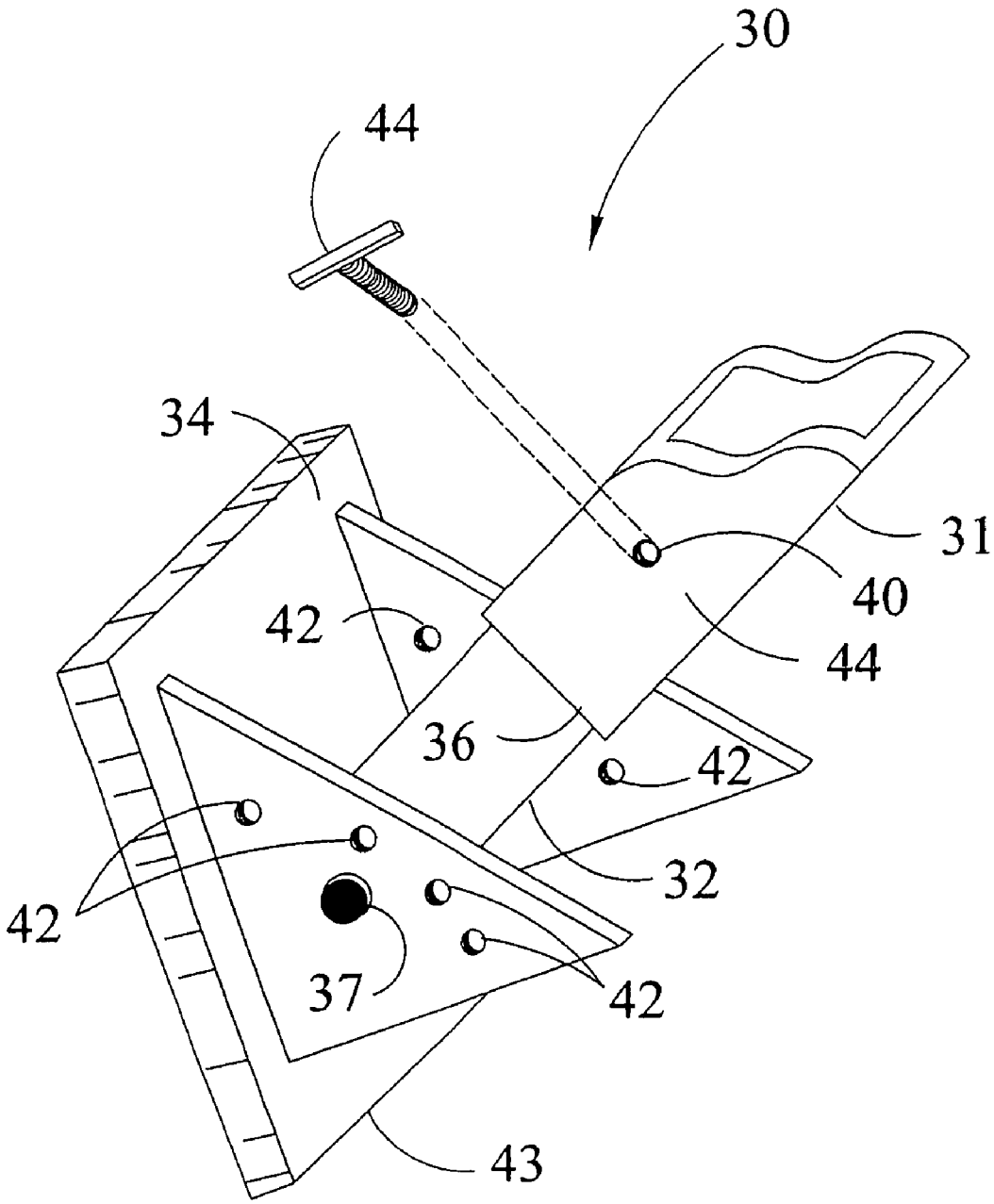
FIG. 6 is a partial perspective view of at least the least one of the three adjustable brace members depicting the anchor pad in accordance with the present invention.

As shown in FIG. 5, the interior tubing member 32 has an interior attached end 38 pivotally attaching to the interior tubing anchor 34 by the fastening means 37, and an opposing interior free end 39. The interior free end 39 of the interior tubing member 32 fits slidably and cooperatively within the exterior free end 36 of the exterior tubing member 31, as shown in FIGS. 5 and 6, whereby the exterior and interior tubing members (31 and 32, respectively) have a plurality of adjustable setting holes 40 cooperatively located along said tubing members (31 and 32) for adjustably engaging the respective tubing members (31 and 32) together by inserting a setting means 44 (shown in FIG. 6) within said respective and cooperatively located adjustable setting holes 40.

In order to properly position the orientation or angle of the said adjustable brace members 30 against the manhole casing 20 as depicted in FIGS. 1 and 2, the exterior tubing member 31 and the exterior tubing anchor 33 each having a plurality of cooperative pivot holes 42 for pivotally positioning and securing the exterior tubing member 31 within the exterior tubing anchor 33, by inserting the setting means 44 (shown in FIG. 6) within said pivot holes 31, shown in FIG. 5. As well, in order to insure the proper positioning and orientation or angle of the said adjustable brace members 30 against the manhole casing 20 as depicted in FIGS. 1 and 2, the interior tubing member 32 and the interior tubing anchor 34 each have the plurality of cooperative pivot holes 42 for pivotally positioning and securing the interior tubing member 32 within the interior tubing anchor 34, by inserting the setting means 44 within said pivot holes 42, shown in FIG. 5.

As depicted in FIG. 5, the interior tubing anchor 34 has an anchor pad 43 for securely engaging and positioning each of the at least three adjustable braces 30 in frictional contact against the sidewall 21 of the manhole casing 20, each of said brace members 30 extending from the underside surface 16 of the scaffold catwalk 11 (shown in FIG. 2) and adjusted in length by the adjusting mechanism provided by the exterior tubing member 31, the interior tubing member 32, and the plurality of adjustable setting holes 40, to securely and concurrently contact the sidewall 21, whereby the adjustable exterior and interior tubing members (31 and 32) selectively and concurrently engage the angled sidewall portion 24 and the vertical sidewall portion 25 of the conical section 22 of the manhole casing 20. In this manner, as shown in FIGS. 1 and 2, the manhole casing safety and work platform device 10 of the present invention is safely and securely positioned against the sidewall 21 of the manhole casing 20.

In one embodiment of the present invention, the safety barrier means 18 (as shown in FIG. 1) is a handrail. In another embodiment of the present invention, the setting means 44 is a threaded bolt or a cotter pin.

As is common in the industry, the conical section 22 of the manhole casing 20 (shown in FIG. 1) may be an asymmetrical conical section. As noted above, one objective of the present invention is to provide a scaffolding platform or deck, the manhole casing safety and work platform device 10 of the present invention supported with at least three adjustable brace members 30 to securely support the said platform 10 against the sidewall 21 of any shape of manhole casing 20.

Providing efficient quick relocation of said device 10 at the work site in another object of the present invention. In another embodiment of the device 10 of the present invention, the scaffold catwalk 11 has at least three picking eye bolts 45 located at the outer perimeter 14 of the scaffold catwalk 11, as depicted in FIG. 1.

The elements of the present invention shown and described herein in one embodiment provide a method for providing a safety and work platform for working on manhole construction.

The present invention is intended to cover all changes, modifications, and variations of the example of set invention herein chosen for purposes of the disclosure, which do not constitute departures from the spirit and scope of the present invention. Since many changes, modifications, and variations of the disclosed embodiments of the present invention intended to be covered by the appended claims, may be made without departure from the inventive concept, it is not intended to limit the present invention otherwise than is required by the appended claims.

I claim:

1. A manhole construction safety and work platform device in combination with a manhole casing, comprising:

(a) a scaffold catwalk constructed of a grating means for working on the manhole casing;

(b) the scaffold catwalk having an inner perimeter and an outer perimeter, a working surface and an underside surface;

(c) the inner perimeter circumferentially defining a central access opening for receiving the manhole casing;

(d) the scaffold catwalk having a safety barrier means located on the working surface and along the outer perimeter of the scaffold catwalk;

(e) the safety barrier means having a work access gap for accessing the scaffold catwalk;

(f) the manhole casing having a sidewall comprising a conical section and at least one vertical section;

(g) the conical section having an angled sidewall portion and a vertical sidewall portion;

(h) the central access opening receiving the conical section of the manhole casing through the opening;

(i) at least three adjustable brace members, each of said brace members comprising an exterior tubing member, an interior tubing member, an exterior tubing anchor, and an interior tubing anchor;

(j) said exterior tubing member having an exterior attached end, pivotally attaching to the exterior tubing anchor, and an opposing exterior free end;

(k) the exterior tubing anchor being attached to the underside surface proximate to the outer perimeter of the scaffold catwalk;

(l) the exterior tubing member pivotally attaching to the exterior tubing anchor by a fastening means;

(m) the interior tubing member having an interior attached end, pivotally attaching to the interior tubing anchor by the fastening means, and an opposing interior free end;

(n) the interior free end of the interior tubing member fitting slidably and cooperatively within the exterior free end of the exterior tubing member;

(o) the exterior and interior tubing members having, respectively, a plurality of adjustable pivot holes cooperatively located along said tubing members for adjustably engaging the respective tubing members together by inserting a setting means within said respective and cooperatively located adjustable pivot holes;

(p) the exterior tubing member and the exterior tubing anchor each having the plurality of adjustable pivot holes for pivotally positioning and securing the exterior tubing member within the exterior tubing anchor, by inserting the setting means within said pivot holes;

(q) the interior tubing member and the interior tubing anchor each having the plurality of adjustable pivot holes for pivotally positioning and securing the interior tubing member within the interior tubing anchor, by inserting the setting means within said pivot holes;

(r) the interior tubing anchor having an anchor pad securely engaging and positioning each of the at least three adjustable braces in frictional contact against the sidewall of the manhole casing;

(s) each of said brace members extending from the underside surface and adjusted to securely and concurrently contact the sidewall; and having adjustable exterior and interior tubing members selectively and concurrently engage the angled portion and the vertical portion of the conical section of the manhole casing;

(t) whereby the manhole construction safety and work platform device is safely and securely positioned against the sidewall of the manhole casing.

2. The device according to claim 1, wherein the safety barrier means is a handrail.

3. The device according to claim 1, wherein the setting means is a threaded bolt or a cotter pin.

* * * * *